US005321234A

United States Patent [19]

Ooyama et al.

[11] Patent Number: 5,321,234

[45] Date of Patent: Jun. 14, 1994

[54] LINEAR HEATER

[75] Inventors: Shingo Ooyama; Shigeo Ota, both of Kyoto, Japan

[73] Assignee: Rohm Co., Ltd., Kyoto, Japan

[21] Appl. No.: 35,038

[22] Filed: Mar. 22, 1993

[30] Foreign Application Priority Data

Mar. 26, 1992 [JP] Japan ..... 4-68822

[51] Int. Cl.[5] ..... H05B 3/16

[52] U.S. Cl. ..... 219/543; 346/76 PH

[58] Field of Search ..... 219/543, 216; 338/306, 338/308, 309; 346/76 PH; 355/285

[56] References Cited

U.S. PATENT DOCUMENTS

| | | | |
|---|---|---|---|
| 4,204,107 | 5/1980 | Ohkubo et al. | 219/216 |
| 4,413,170 | 11/1983 | Val et al. | 219/543 |
| 4,691,210 | 9/1987 | Nishiguchi et al. | 219/543 |
| 5,068,517 | 11/1991 | Tsuyuki et al. | 219/543 |

FOREIGN PATENT DOCUMENTS

| | | | |
|---|---|---|---|
| 61-192564 | 8/1986 | Japan | 219/543 |
| 61-192565 | 8/1986 | Japan | 219/543 |
| 61-272168 | 12/1986 | Japan | 346/76 PH |

*Primary Examiner*—Geoffrey S. Evans
*Attorney, Agent, or Firm*—William H. Eilberg

[57] ABSTRACT

A linear heater comprises an insulating substrate, at least one resistor strip formed on the substrate, and a heat-resistant protective coating formed on the substrate for covering the resistor strip. The resistor strip has a double-layer structure which includes a first resistor layer formed directly on the substrate, and a second resistor layer formed on the first resistor layer. The first resistor layer has a pair of upwardly bulging longitudinal margins, whereas the second resistor layer is formed between the pair of upwardly bulging longitudinal margins of the first resistor layer to provide a substantially flat surface.

4 Claims, 4 Drawing Sheets

LINEAR HEATER

BACKGROUND OF THE INVENTION

1. Field of the Invention:

This invention relates generally to heaters. More specifically, the present invention relates to a linear heater which can be advantageously used in an office automation apparatus such as a photocopier or electrophotographic printer for fixing images on a paper sheet for example.

2. Description of the Prior Art:

Various types of linear heaters are known for fixing images (deposited toner) on a paper sheet in photocopiers or electrophotographic printers (e.g. laser beam printer). Typical examples include a lamp heater and a roller heater.

However, the lamp heater and roller heater are equally disadvantageous in that there is a limitation in reducing size (thickness) and cost. Further, the lamp heater is easily damaged due to the nature of material, whereas the roller heater has a complicated structure due to the necessity of incorporating plural heating elements within the roller.

To eliminate the problems of the conventional heaters, it has been proposed to use a linear heater for fixing images on a paper sheet in electrophotography, as disclosed for example in U.S. Pat. No. 5,068,517. For the convenience of explanation, a typical arrangement of a prior art linear heater is shown in FIGS. 6 and 7 of the accompanying drawings.

As shown in FIGS. 6 and 7, the typical prior art linear heater comprises an elongate ceramic insulating substrate A1 formed with a printed resistor strip A2 extending longitudinally of the substrate. Each end of the resistor strip A2 is provided with a conductor terminal pad A3 made of e.g. silver for connection to a power source (not shown). The resistor strip A2 is covered by a heat-resistant protective coating A4 for providing electrical insulation in addition to insuring smooth contact with a sheet material to be heated. The resistor strip A2, which is made of silver-palladium alloy for example, generates heat when a current is passed therethrough.

Obviously, the prior art linear heater is very simple in arrangement. Further, the linear heater can be made very thin and light by reducing the thickness of the substrate A1. Moreover, the linear heater is also advantageous in that the time required for warming up is very short. However, the prior art linear heater still has the following problem.

As described already, the resistor strip A2 is formed by depositing a paste material over the substrate A1 and thereafter allowing the paste to harden by drying. Due to the surface tension of the paste, it tends to bulge upward at the respective longitudinal margins A2' of the resistor strip A2 before complete hardening, as shown in FIG. 7. As a result, the protective coating A4 subsequently formed over the resistor strip A2 will have a larger thickness T1 immediately above the resistor strip A2 but a smaller thickness T2 at positions corresponding to the upwardly bulging longitudinal margins A2' of the resistor strip A2.

Obviously, if the thickness T2 of the protective coating A4 at the longitudinal margins A2' of the resistor strip A2 is too small, the protective coating A4 fails to provide intended insulation at these positions. Thus, to be safer, the protective coating A4 as a whole must be rendered thick enough. However, such a solution gives rise to another problem that the increased thickness T1 of the protective coating A4 immediately above the resistor strip A2 hinders thermal transmission from the resistor strip A2, consequently failing to provide an intended heating function.

SUMMARY OF THE INVENTION

It is, therefore, an object of the present invention to provide a linear heater wherein a protective coating provides an intended electrical insulation without unduly increasing its thickness as a whole.

According to the present invention, there is provided a linear heater comprising: an insulating substrate; at least one resistor strip formed on the substrate; and a heat-resistant protective coating formed o the substrate for covering the resistor strip; wherein the resistor strip has a double-layer structure which includes a first resistor layer formed directly on the substrate, and a second resistor layer formed on the first resistor layer, the first resistor layer having a pair of upwardly bulging longitudinal margins, the second resistor layer being formed between the pair of upwardly bulging longitudinal margins of the first resistor layer.

With the arrangement described above, the first resistor layer still has its upwardly bulging longitudinal margins. However, the longitudinal recess between the bulging longitudinal margins is occupied by the second resistor layer. As a result, the double-layer resistor strip will have a substantially flat top surface, thereby equalizing the thickness of the protective coating above the double-layer resistor strip. It is thus possible to insure good and uniform thermal transmission from the double-layer resistor strip through the protective coating without deteriorating electrical insulation.

Preferably, the second resistor layer should have a thickness which is substantially equal to a bulging height of the longitudinal margins of the first resistor layer. Such an arrangement provide further improved flatness of the double-layer resistor strip, thus additionally equalizing the thickness of the protective coating above the resistor strip.

The linear heater according to the present invention may comprise a plurality of double-layer resistor strips arranged in parallel to each other on the substrate. The obtainable heat energy may be adjusted by changing the total number of resistor strips to be incorporated in the heater.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
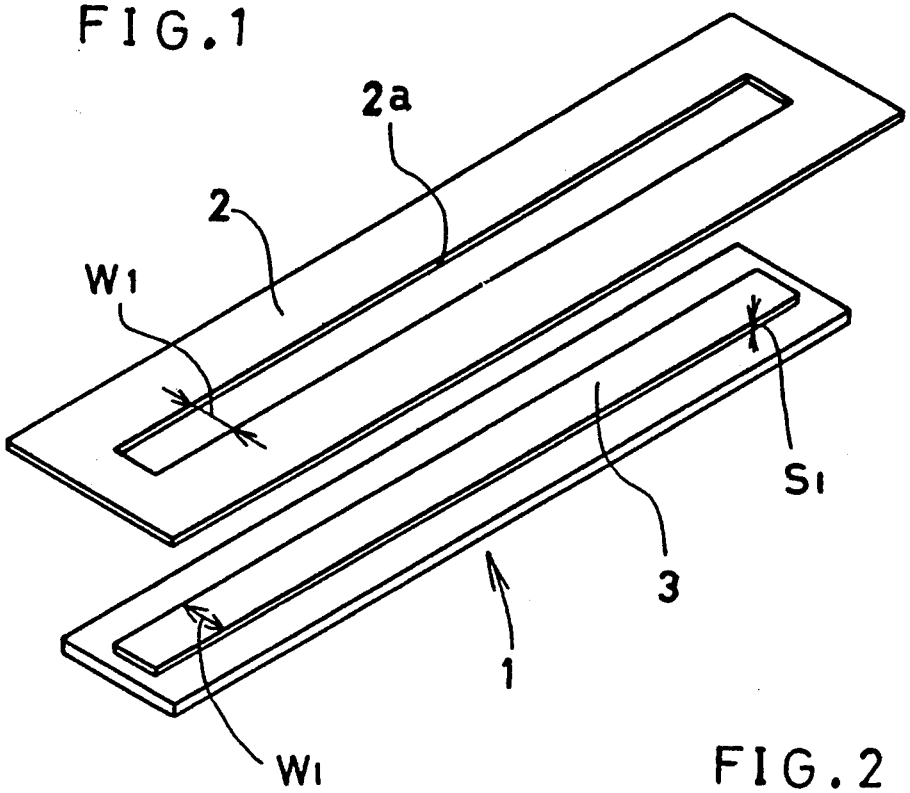
FIG. 1 is a perspective view showing a resistor forming step for making a linear heater according to the present invention.
Figure 2:
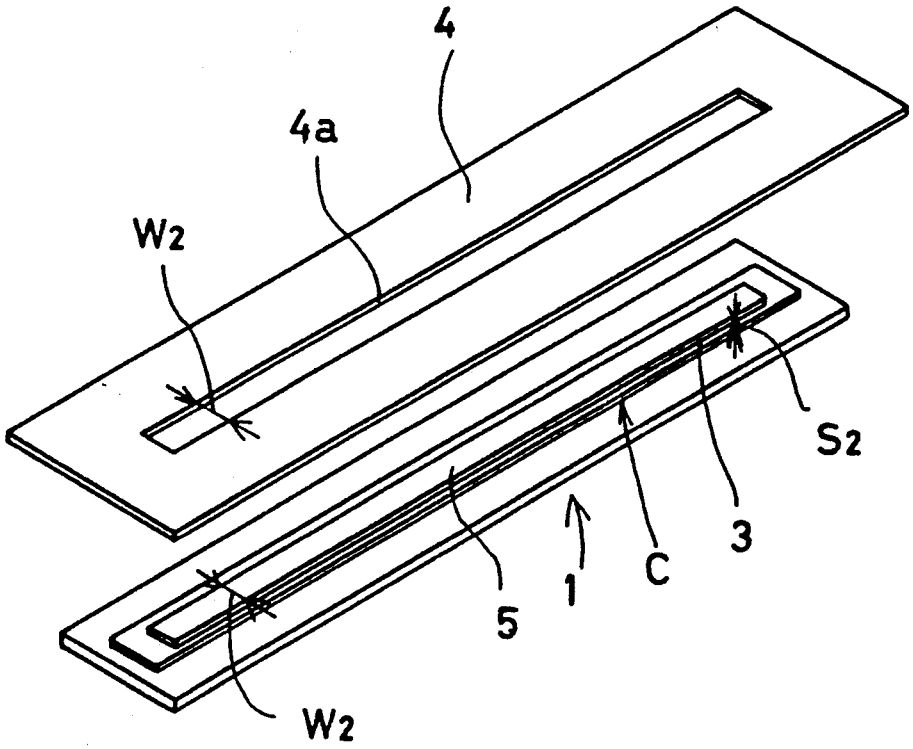
FIG. 2 is a perspective view showing a pad forming step for making the same heater.
Figure 3:
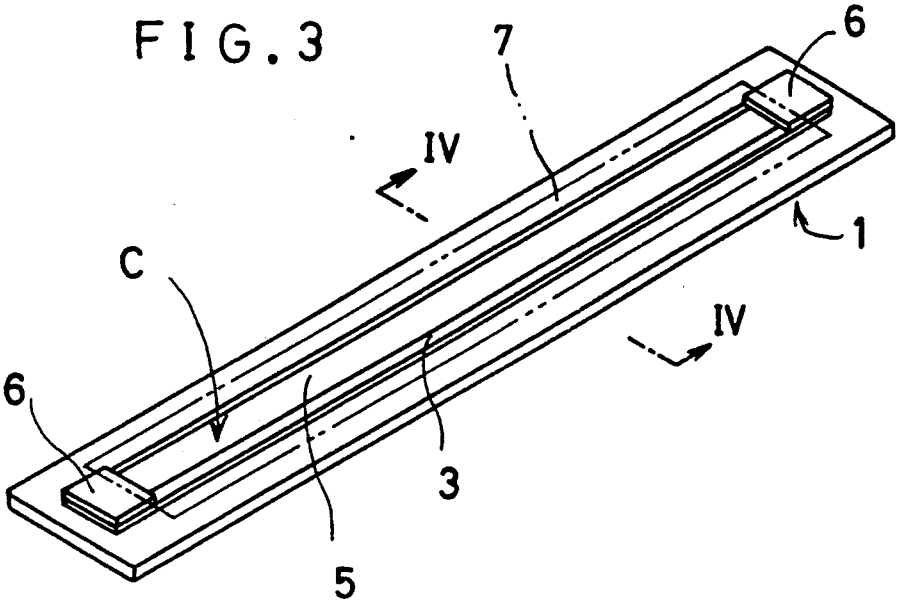
FIG. 3 is a perspective view showing the same heater as a final product.
Figure 4:
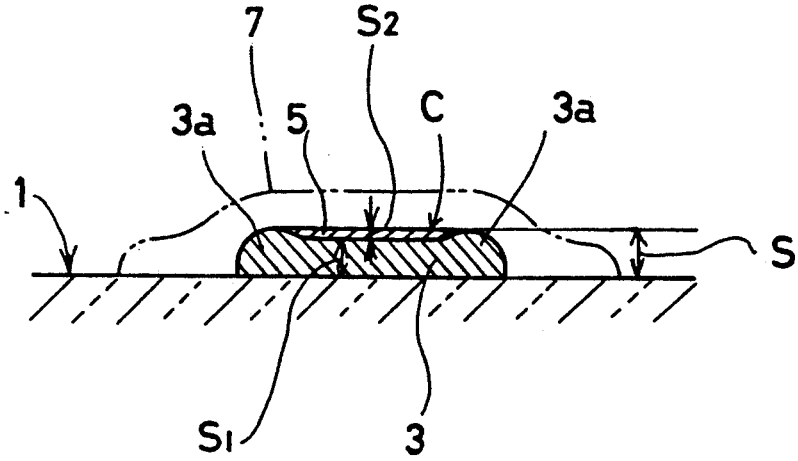
FIG. 4 is a sectional view taken along lines IV—IV in FIG. 3.

FIGS. 1 through 3 of the accompanying drawings show the successive steps of making a linear heater according to a first embodiment of the present invention, whereas FIG. 4 shows the same heater as a final product.

For making the linear heater, a first resistor layer 3 having a width W1 and a thickness S1 (see FIG. 4) is initially formed on an elongate insulating substrate 1 by a screen printing method for example, as shown in FIG. 1. For this purpose, use is made of a stencil 2 having a window slit 2a whose width is equal to that of the first resistor layer 3. The substrate 1 may be made of a heat-resistant insulating material such as ceramic (e.g. alumina). The first resistor layer 3 may be made by depositing a paste of silver-palladium (Ag-Pd) or ruthenium oxide in the illustrated form and thereafter baking the paste in an oven (not shown) for fixation. After formation, the first resistor layer 3 will have a pair of longitudinal margins 3a which bulges upwardly (see FIG. 4).

Then, as shown in FIG. 2, a second resistor layer 5 having a width W2 and a small thickness S2 is formed on the first resistor layer 3 by a screen printing method for example. For this purpose, use is made of another stencil 4 having a window slit 4a whose width is equal to that of the second resistor layer 5. The second resistor layer 5 may be made of the same material as the first resistor layer 3.

Obviously, the width W2 of the second resistor layer 5 is set smaller than the width W1 of the first resistor layer 3. Preferably, the thickness S2 of the second resistor layer 5 is substantially equal to the bulging height of the respective longitudinal edges 3a of the first resistor layer 3.

As a result of this process step shown in FIG. 2, a double-layer resistor strip C having a width W1 (which is the width of the first resistor layer 3) and a combined thickness S is provided by the combination of the first and second resistor layers 3, 5.

Then, as shown in FIG. 3, a pair of conductor terminal pads 6 are formed on the double-layer resistor strip C at both ends thereof. The terminal pads 6 may be made of metal such as copper, silver or gold.

Finally, as also shown in FIG. 3, a protective coating 7 is formed on the substrate 1 again by a screen printing method for example for covering the double-layer resistor strip C. The protective coating 7 may be made of a heat-resistant insulating material such as glass (initially in a pasty condition).

As shown in FIG. 4, the first resistor layer 3 per se has its upwardly bulging longitudinal margins 3a, thereby forming a shallow longitudinal recess between the longitudinal margins 3a. However, such a longitudinal recess is occupied by the second resistor layer 5 which is subsequently formed. As a result, the double-layer resistor strip C will have a substantially flat top surface, thereby equalizing the thickness of the protective coating 7 above the double-layer resistor strip C. It is thus possible to insure good and uniform thermal transmission from the double-layer resistor strip C through the protective coating 7 without deteriorating electrical insulation.

Figure 5:
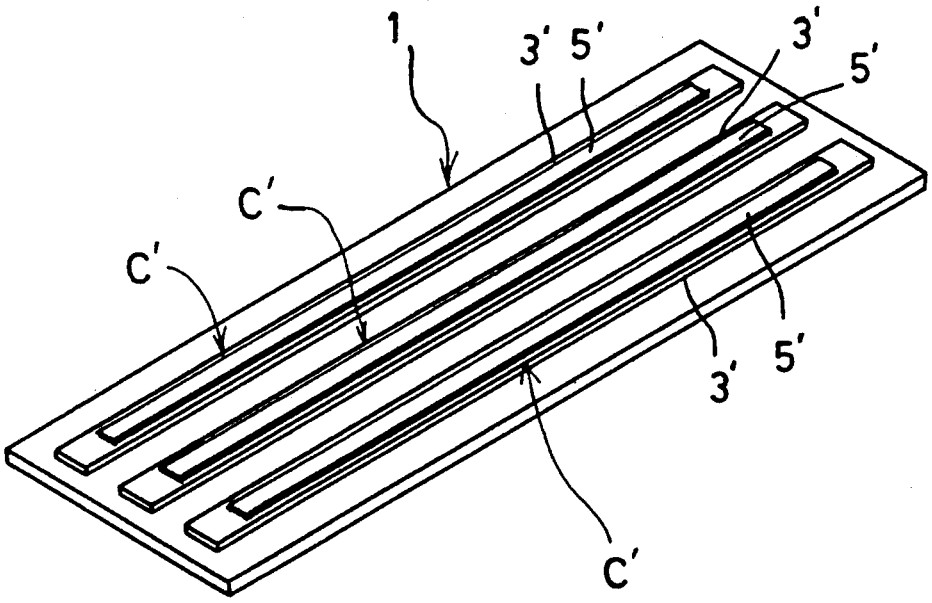
FIG. 5 is a perspective view showing another linear heater according to the present invention.
Figure 6:
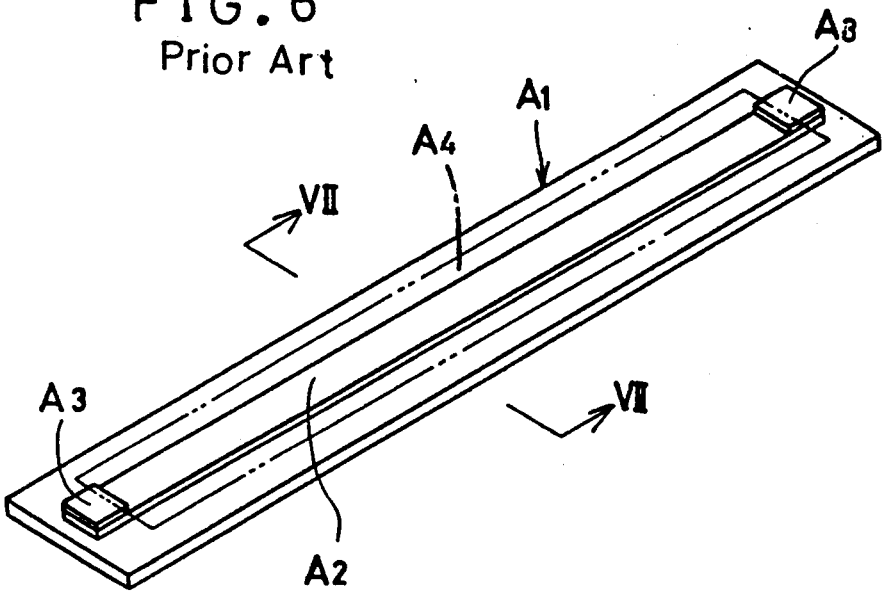
FIG. 6 Prior Art
FIG. 6 is a perspective view showing a prior art linear heater.
Figure 7:
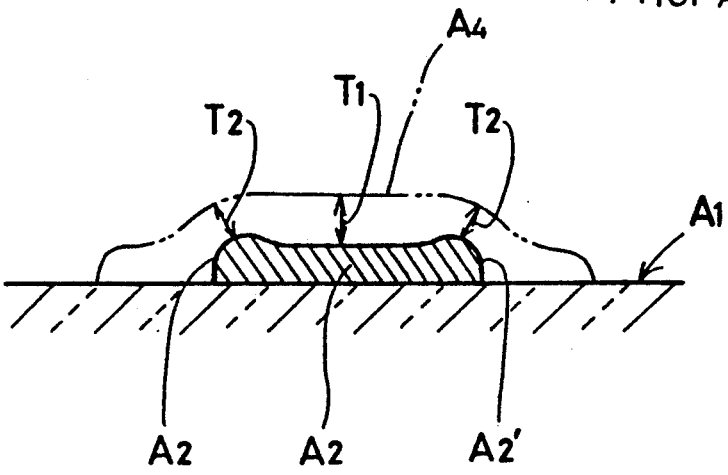
FIG. 7 Prior Art
FIG. 7 is a sectional view taken along lines VII—VII in FIG. 6.

FIG. 5 shows a linear heater according to a second embodiment of the present invention. The heater of this embodiment comprises an elongate insulating substrate 1' which is increased in width for carrying a plurality (e.g. three) of double-layer resistor strips C' in parallel to each other.

Similarly to the first embodiment, each of the double-layer resistor strips C' in the second embodiment comprises a first resistor layer 3' and a second resistor layer 5'. Of course, the double-layer resistor strip C' is covered by a protective coating (not shown), and the double-layer resistor strip C' is formed, at both ends, with respective conductor terminal pads (also not shown).

The present invention being thus described, it is obvious that the same may be varied in many ways. For instance, the linear heater according to the present invention may be also used for heat-sealing a thermoplastic sheet in addition to image fixation. Such variations are not to be regarded as a departure from the spirit and scope of the invention, and all such modifications as would be obvious to those skilled in the art are intended to be included within the scope of the following claims.

We claim:

1. A linear heater comprising:

an insulating substrate;

at least one resistor strip formed on the substrate; and a heat-resistant protective coating formed on the substrate for covering the resistor strip;

wherein the resistor strip has a double-layer structure which includes a first resistor layer formed directly on the substrate, and a second resistor layer formed on the first resistor layer, the first resistor layer having a pair of upwardly bulging longitudinal margins with a bulging height, the second resistor layer being formed between the pair of upwardly bulging longitudinal margins of the first resistor layer and have a height substantially equal to the bulging height of the longitudinal margins of the first resistor layer.

2. The linear heater according to claim 1, wherein the second resistor layer is smaller in thickness than the first resistor layer.

3. The linear heater according to claim 1, which comprises a plurality of double-layer resistor strips arranged in parallel to each other on the substrate.

4. The linear heater according to claim 1, wherein the first and second resistor layers are made of a same material.

* * * * *